US007028519B2

(12) United States Patent
Kim et al.

(10) Patent No.: US 7,028,519 B2
(45) Date of Patent: Apr. 18, 2006

(54) HIGH THROUGHPUT QUICK-PLASTIC-FORMING

(75) Inventors: Chongmin Kim, Bloomfield Township, MI (US); Gary A. Kruger, Troy, MI (US)

(73) Assignee: General Motors Corporation, Detroit, MI (US)

( * ) Notice: Subject to any disclaimer, the term of this patent is extended or adjusted under 35 U.S.C. 154(b) by 254 days.

(21) Appl. No.: 10/755,486

(22) Filed: Jan. 12, 2004

(65) Prior Publication Data

US 2005/0150265 A1 Jul. 14, 2005

(51) Int. Cl.
*B21D 22/10* (2006.01)
*B21D 26/02* (2006.01)

(52) U.S. Cl. ..... 72/60; 72/57

(58) Field of Classification Search ..... 72/709
See application file for complete search history.

(56) References Cited

U.S. PATENT DOCUMENTS 6,241,939 B1 * 6/2001 Takada et al. ..... 264/535
6,253,588 B1 7/2001 Rashid et al.
6,613,164 B1 * 9/2003 Dykstra et al. ..... 148/520

* cited by examiner

*Primary Examiner*—Derris H. Banks
*Assistant Examiner*—Debra M Wolfe
(74) *Attorney, Agent, or Firm*—Kathryn A. Marra

(57) ABSTRACT

A method of quick-plastic-forming a component from a sheet metal blank in multiple forming stages of single-action tooling along a transfer line. The blank is transferred from a prebending station to a preforming station along the transfer line, wherein the blank is preformed by a single-action forming tool into a preform blank. The preform blank is then transferred from the preforming station to a finish-forming station along the transfer line, wherein the blank is finish-formed by a single-action forming tool into the component. The component is transferred from the finish-forming station to a cooling station along the transfer line. The transfer steps are carried out by a reciprocating transfer mechanism that simultaneously transfers the blanks and component from station to station along the transfer line.

11 Claims, 2 Drawing Sheets

HIGH THROUGHPUT QUICK-PLASTIC-FORMING

TECHNICAL FIELD

The present invention generally relates to hot blow-forming of sheet metal against a forming tool surface using a pressurized working gas to stretch the sheet. More specifically, the present invention relates to a high production method of producing hot blow-formed parts using a transfer line equipped with multiple stages of single-action quick-plastic-forming (QPF) tools.

BACKGROUND OF THE INVENTION

In some quick-plastic-forming processes, a sheet of formable metal is preheated to a temperature at which it can be stretched by a pressurized working gas against a forming surface of a heated forming tool. The sheet is then gripped around its edges by a binder apparatus surrounding the heated forming tool and thereafter a pressurized gas is applied to one side of the sheet to stretch the sheet and push an opposite side of the sheet into conformance with the forming surface of the heated forming tool. Often the pressure of the working gas is continually increased during the stretch forming in accordance with a pressurizing schedule. The sheet is thus permanently deformed, the gas vented, and the formed sheet removed from the heated forming tool.

Even though highly formable sheet metal alloys are used, it is sometimes found that a particular product shape cannot be obtained in a single hot stretch forming step without tearing or otherwise damaging the sheet metal. For example, certain automotive vehicle body panels cannot be reliably formed in a single hot stretch forming step even with a superplastically formable material such as fine grain AA5083, a magnesium and manganese containing aluminum alloy. In such a situation it is often possible to form the final product shape in two or more forming steps. The forming characteristics of the sheet material are considered in a plan to transform a flat or simply curved blank of suitable thickness and shape to the desired product configuration in two stretching steps. To this end, sophisticated double-action forming tools have been developed for preforming and final shape forming of a sheet metal workpiece using two forming tool halves in a single press. Such double-action forming tools typically operate in two stages. The first stage is a preforming stage for eliminating fold formation, and for creating necessary lengths of line and relatively uniform panel thickness distribution. The preform stage accomplishes a major portion of the stretching and elongation of the sheet in forming the sheet toward its final part shape. The finish stage completes bends and recessed corners and defines a final detailed shape of the sheet metal part.

In the preform stage either a punch tool or the pressure of a suitable working gas, such as air or nitrogen, is used to push against one side of the sheet and stretch it against a hot preform tool surface. Then gas pressure is applied to the opposite side of the sheet to stretch it in the opposite direction against a hot finish form tool. Thus, the necessary elongation lines or stretch directions in the sheet to form the part are predetermined. A substantial part of the elongation is accomplished in the preform step and is introduced nearly evenly over the preform shape. The final elongation is accomplished by forcing the preformed sheet away from the preform tool against the shaping surfaces of the finish-form tool.

The double-action stretch forming process is efficient in its utilization of a single press with upper and lower forming tools to transform a blank into a final product shape. However, the time required for the two stage forming steps limits the output of a single press. In order to produce more finished panels or other parts by such a practice, more presses with double action tooling are required and such manufacturing equipment is relatively complex and expensive. Accordingly, there is a need to increase the throughput of hot blow-forming operations for automotive body panels and other sheet metal parts while using less expensive tooling and presses.

SUMMARY OF THE INVENTION

The present invention meets this need by providing an improved method of hot blow-forming a substantially three-dimensional component from a substantially two-dimensional blank in multiple forming stages along a transfer line, wherein one or more of the forming stages include substantially single-action tooling having built-in heating means. The single-action tooling is of simple two-piece construction having final component geometry lying wholly on one half of the tooling and may include auxiliary devices such as panel extractors and the like. The blank may be a superplastically formable metal alloy such as AA5083, which is a magnesium containing aluminum alloy.

In general, the strategy of the invention is to adapt the two (or more) hot stretch-forming operations required for forming the part into two or more relatively low-cost stretch-forming tools that become part of a transfer line. It is recognized that the critical forming steps generally require more time than the steps of blank preheating, blank prebending, and the like. Accordingly, in a preferred embodiment of the invention, the respective forming steps are planned so that the forming time at each station is about the same for the purpose of increasing the overall speed of the transfer line. Preferably, the present invention includes two or more QPF tools in series, but may include one or more mechanical hot stretch-forming tools.

According to an example of a practice of the invention the blank is transferred from a prebending station to a first stage or preforming station along the transfer line, wherein the blank is formed by a heated single-action forming tool into a first stage form or preform. The preform is then transferred from the preforming station to a second stage or finish-forming station along the transfer line, wherein the preform is finish-formed into a second stage form or component by first applying a pressurized working gas against the preform blank to stretch it against a finish-form surface of a finish-form tool that is internally heated to maintain the finish-form surface at a finish-form temperature that is lower than the preforming temperature. The component is then transferred from the finish-forming station to a cooling station. The present invention is not limited to just two forming stations consisting of preform and finish-form stations. Rather, the present invention encompasses any number of multiple forming stations composed of single-action tooling.

The moving or transferring steps are carried out by a transfer apparatus that simultaneously transfers the blank, preform, and component from respective station to station along the transfer line. Also, the preform and finish-form operations of the present invention are spread among two or more individual stations that use relatively simple and inexpensive single-action tools, instead of one station that uses relatively complex double-action tools. With current QPF processes, a finished component cannot be removed from double-action tooling until both preform and finish-form stages are complete, thus yielding a part-to-part cycle time that is equivalent to the sum of the preform and finish-form stages. In contrast, the present invention enables a part-to-part cycle time for producing the finished component that is equal to the cycle time of the constraint station of the transfer line. In other words, the present invention cycle time equals the longest cycle time of any individual station used in the process, which tends to be the cycle time of the finish-form stage. Accordingly, the present invention eliminates cycle time that is equivalent to at least the preform cycle time of a double-action tooling QPF process. The present invention can further reduce cycle time wherein the QPF forming steps can be planned so as to more uniformly balance the individual cycle times of each stage or station.

BRIEF DESCRIPTION OF THE DRAWINGS

These and other features and advantages of the invention will become apparent upon reading the detailed description in combination with the accompanying drawings, in which.

DESCRIPTION OF THE PREFERRED EMBODIMENT

In general, the present invention has application in a multiple stage hot blow-forming process that uses two or more single-action forming tools, wherein pressurized gas is applied to one surface of a preheated workpiece to stretch the workpiece against a forming surface on a form tool. Articles of complex shape such as automobile body panels can be made by such a practice using suitable high elongation alloys such as AA5083 aluminum sheet material that is about 1–2 mm in thickness. A single-stage hot blow-forming process that uses a single action forming tool is disclosed in U.S. Pat. No. 6,253,588 to Rashid et al., which is assigned to the assignee of the present invention and which is incorporated by reference herein.

Figure 1:
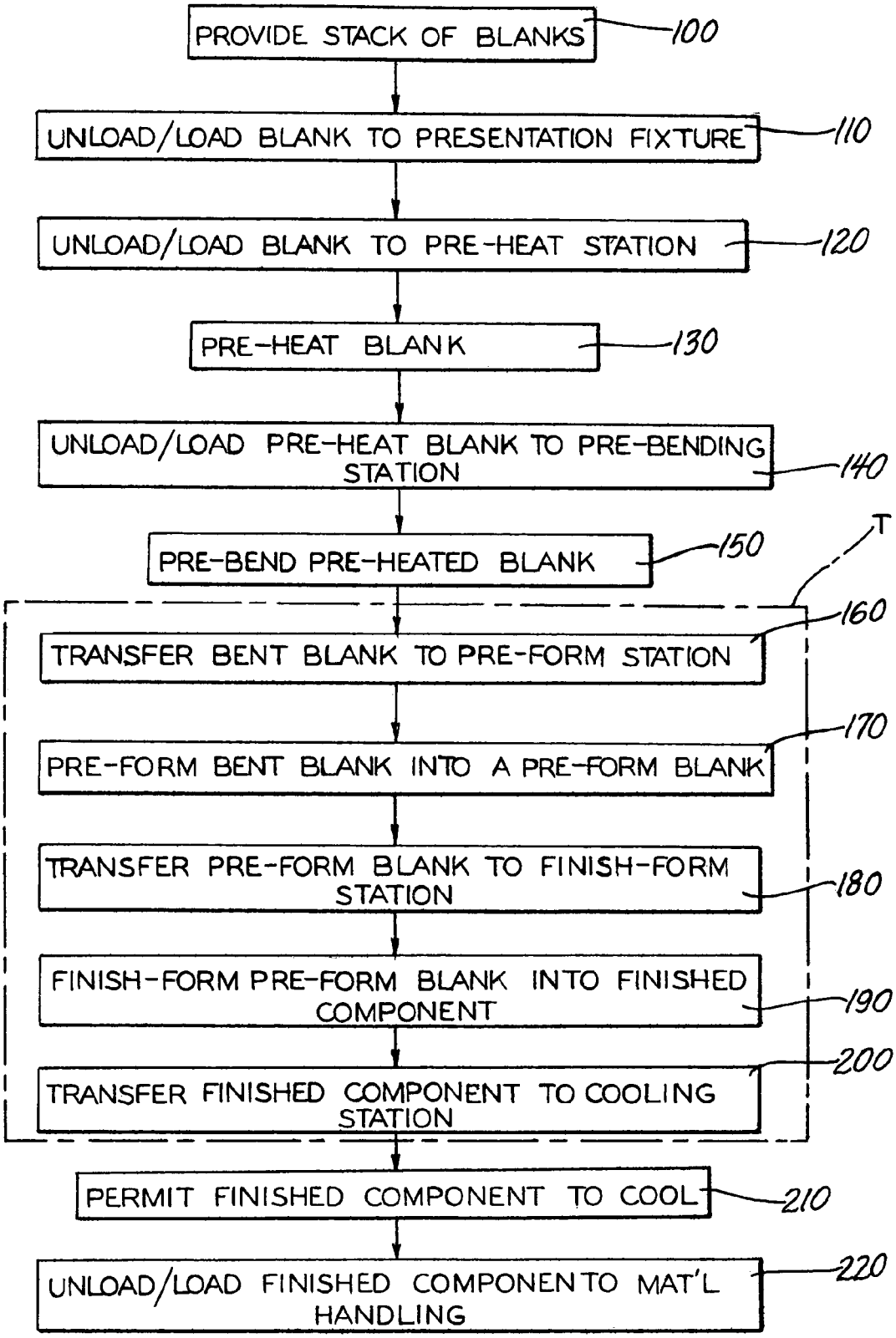
FIG. 1 is a flowchart of a process according to the present invention.

Referring specifically now to the Figures, there is illustrated in FIG. 1 a flowchart of a process in accordance with the present invention. In step 100 of the process, a stack of blanks of sheet material are provided. The blanks are preferably sheet metal such as a magnesium-containing alloy like AA5083. It is contemplated, however, that the present invention applies to other types of materials that are formable by hot stretching processes. The blanks may be provided atop a pallet, on a specialized fixture, or the like.

In step 110, one blank is unloaded from the stack of blanks by a material handling device such as a robot, a pick-and-place mechanism, or the like. The material handling device may either grip the edges of the blank or may have a suction-cup equipped end-effector for gripping a top surface of the blank. Also, in step 110, the blank is loaded to a presentation fixture by the material handling device, and the material handling device returns empty to where the stack of blanks is located.

In step 120, the blank is unloaded from the presentation fixture and loaded to a preheating station by a material handling device such as a robot or a pick-and-place unit. In step 130, the blank is preheated in a forced-convection oven having a sheet drawer. The sheet drawer is opened and the blank is placed therein. Then the drawer closes and the blank is heated to a preheat temperature, preferably between about 475° C. to about 550° C. After about 30 to 100 seconds, the blank reaches the preform temperature and the drawer opens to present a preheated blank. Alternatively, the blanks can be preheated in a conductive heating device that utilizes electrically heated flat platens and a series of pneumatically operated pins to load the cold blank and then lift the heated blank for robotic pickup. The lower platen is fixed and the upper platen is movable vertically. The blank rests on the lower platen and the face of the upper platen is positioned to within 0.5 mm of the upper surface of the blank.

In step 140, the preheated blank is unloaded from the drawer of the preheat station and loaded to a prebending station by a material handling device, such as a robot, pick-and-place unit, or the like. In step 150, the preheated blank is prebent, preferably but not necessarily, about one axis of the blank. The blank may be prebent by draping the preheated blank across a convex form tool, by stamping the blank, or by otherwise forcibly bending the blank. The blank is prebent to form one or more simple bends so that the blank fits more easily between curved upper and lower tools in downstream forming stations. In other words, the blank is bent to form a "backbone" thereof along one axis so that when the heated blank is placed on a lower forming tool its curved shape follows the binder surface of the lower forming tool. This enables an upper forming tool to pinch the blank uniformly. This backbone also minimizes any "saddling" or buckling of the blank that may cause draw in from the ends of the binder surfaces.

Figure 2:
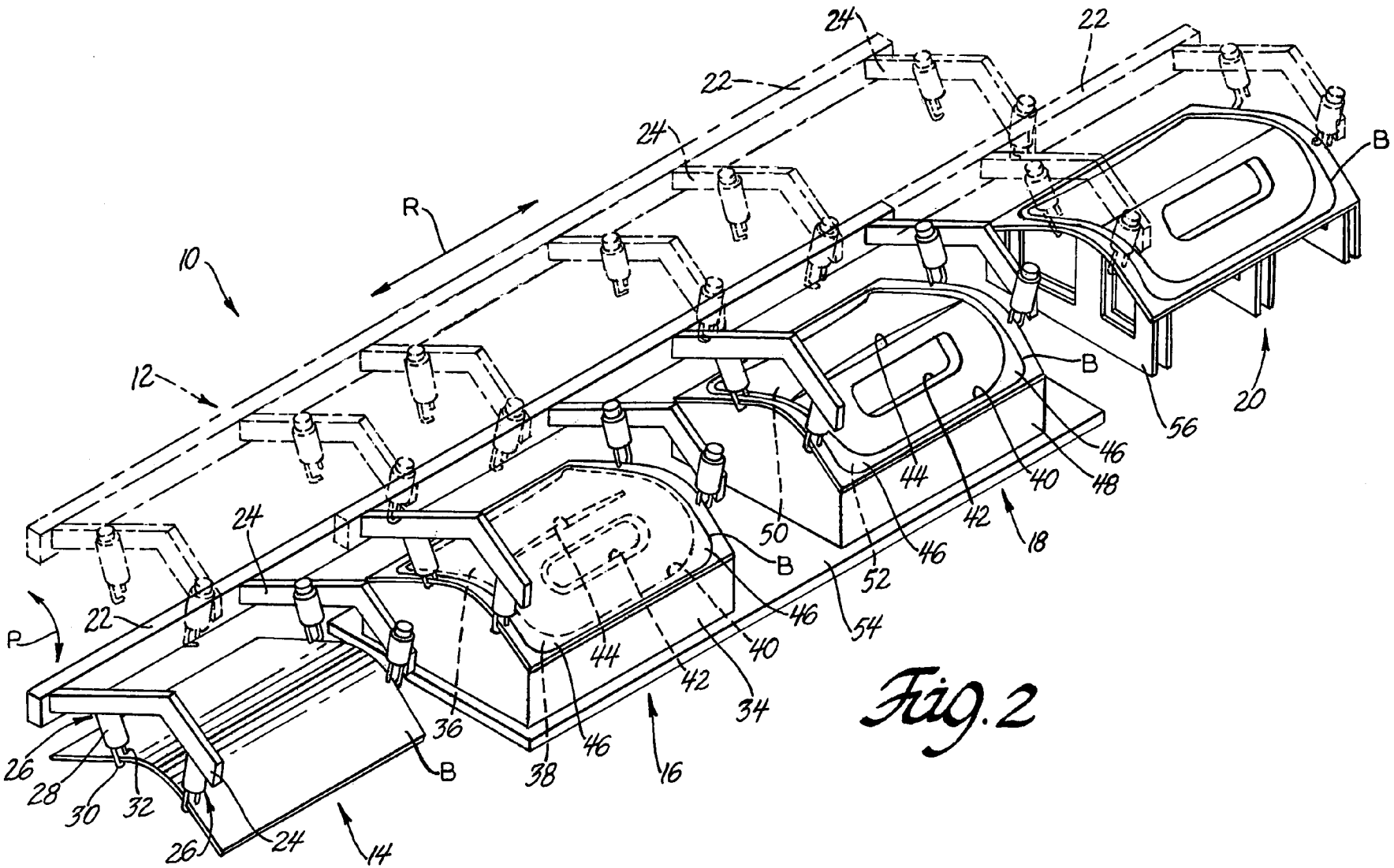
FIG. 2 is a schematic diagram of a portion of the process of FIG. 1.

Picking up from step 150 of FIG. 1, the method of the present invention proceeds to a transfer line process T including steps 160 through 200. From here forward, simultaneous reference is made to both FIG. 1 and FIG. 2. FIG. 2 illustrates a portion of the process of the present invention in the form of a transfer line 10. In general, the transfer line 10 includes a reciprocating transfer mechanism 12, a prebend station 14, a first stage or preform station 16, a second stage or finish-form station 18, and a cooling station 20.

Referring to FIG. 2, the transfer mechanism 12 is preferably a three axis device having clamping, vertical lifting, and lateral transferring sequences. The transfer mechanism 12 includes a transfer bar 22 that acts as a back-bone of the transfer mechanism 12 for connecting three pairs of support arms 24. The transfer bar 22 is preferably attached to a cam operated linkage system (not shown), or the like, that is capable of pivoting or otherwise displacing the transfer mechanism 12 (as depicted by arrow P) in a transverse direction toward and away from the stations 14, 16, 18 as depicted in solid line and hidden line respectively. The cam operated linkage system is also capable of reciprocating the transfer mechanism 12 (as depicted by arrow R) in a longitudinal direction generally along the stations 14, 16, 18, 20 from the prebend station 14 to the cooling station 20 as depicted in solid line and hidden line respectively.

Still referring to FIG. 2, attached to each of the support arms 24 of the transfer mechanism 12 are a pair of grippers 26 that grip opposite ends of the blank B. Each gripper includes a cylinder housing 28, a pivotable hook 30, and a shot-bolt or post 32. The cylinder housing 28 may be an electrically, hydraulically, or pneumatically actuated device with appropriate wires, hoses, and the like (not shown) connecting to appropriate sources of power (not shown).

As shown in FIG. 2, each blank B is firmly gripped between the post 32 and the pivotable hook 30. To initially grip the blank B, however, the pivotable hook 30 must be pivoted clear of the periphery of the blank B. Accordingly, the transfer bar and support arms may be pivoted downwardly toward the stations until the edges of the blank B are positioned generally between the pivotable hook 30 and post 32. Then, under the force of a solenoid, hydraulic pressure, pneumatic pressure, or the like, the pivotable hook 30 pivots toward the blank B. Accordingly, the edges of the blank B become trapped between the posts 32 and pivotable hooks 30.

Referring again to the flowchart of FIG. 1, according to step 160, and as depicted by FIG. 2, the transfer mechanism 12 picks up the blank B from the prebend station 14 in preparation to transfer the blank B to the preform station 16. It should be noted that the transfer mechanism 12 simultaneously picks up blanks from the preform station 16 (as depicted by step 180 of FIG. 1), and from the finish-form station 18 (as depicted by step 200 of FIG. 1).

As depicted by step 170, once the blank B is loaded to the preform station 14, the blank B is preformed by a hot blow-forming process. Referring to FIG. 2, the blank B is loaded atop a lower tool 34 of the preforming station 16. The lower tool 34 includes a first portion 36 that is used for forming a horizontal portion of the blank B such as a horizontal surface on an automobile deck lid. The lower tool 34 also includes a second portion 38 that is used for forming a vertical portion of the blank such as a vertical surface on an automobile deck lid. The lower tool 34 includes recessed features formed therein that are provided to create various features of a finished component such as an automotive deck lid that include an outer profile 40, a license plate depression 42, and a center high mounted stop lamp recess 44.

Consistent with U.S. Pat. No. 6,253,588, an upper tool (not shown) is provided for cooperation with the lower tool 34. The upper tool is complementary in shape with respect to the lower tool 34 and is provided with a shallow cavity for the introduction of a high pressure working gas, e.g. air, nitrogen, or argon, against an upper surface of the blank B. In most cases the preform shape of the part is defined by the upper tool. In this way, the form tool can be "split lined" to improve wrinkling and thinning conditions. In any case, the periphery of the upper tool includes a binder surface that is adapted to engage the addendum or marginal area 46 of the blank B against a complementary binder surface (not shown) on the lower tool 34 to seal the cavity above the blank B. As is known in quick-plastic-forming (QPF) operations, electrical resistance heating means are embedded in the tooling to maintain the tooling at preferred operating temperatures. The preferred operating temperature for the preform tooling is about 475° C. to about 550° C. The blank B is preformed by heating the blank B and applying the gas pressure once the upper tool is closed against the lower tool 34 with the blank B therebetween. The preforming pressure is preferably on the order of about 100 to 300 psi. The blank B accordingly takes the shape of the forming surface of the preform tool 34 and is thereafter termed a preform or preform blank at this point in the process.

Alternatively, step 170 of FIG. 1 may instead involve a conventional stamping operation wherein the blank B is deformed between upper and lower stamping dies (not shown). In other words, the preform station 16 of FIG. 2, may instead be a conventional stamping press station.

In any case, the preforming step 170 involves initially forming relatively large curves with large radii into the general shape of the desired end product, e.g. body panel or deck lid. Thus, one goal in the first stage or preforming stage of a multiple stage blow-forming operation is to complete a substantial portion of the total required deformation in preparation for the downstream finish-forming step(s). In subsequent stages of hot blow-forming, sharper curves with smaller radii are stretch formed therein. During the preforming step 170, the blank assumes the shape of the preform tool within a relatively short period, typically between about 20 and 100 seconds.

At step 180 of FIG. 1, the preformed blank B is transferred from the preform station 16 to the finish-form station 18 by the transfer mechanism of FIG. 2. Simultaneously, a different blank B is transferred to the preform station 16 from the prebend station 14 and yet a different blank B or component is transferred from the finish-form station 18 to the cooling station 20.

Referring again to the flowchart of FIG. 1, and as depicted by step 190, once the now preformed blank is transferred to the finish-form station 18, the blank B is finish-formed by a hot blow-forming process. Referring to FIG. 2, the blank B is loaded atop a lower tool 48 of the finish-forming station 18. As with the preforming station 16, the lower tool 48 of the finish-form station 18 includes a first portion 50 and a second portion 52 that are used for forming horizontal and vertical portions of the blank B such as horizontal and vertical surfaces on an automobile deck lid. The lower tool 48 includes recessed features formed therein that are provided to finish the previously preformed features into finished form features including the outer profile 40, the license plate depression 42, and the center high mounted stop lamp recess 44.

Again, an upper tool (not shown) is provided for cooperation with the lower tool 48. As before, the upper tool is complementary in shape with respect to the lower tool 48 and is provided with a shallow cavity for the introduction of a high pressure working gas, e.g. air, nitrogen, or argon, against an upper surface of the blank B. The periphery of the upper tool includes a binder surface that is adapted to engage the perimeter or a marginal area 46 of the blank B against a corresponding binder surface (not shown) on the lower tool 48 to seal the cavity above the blank B.

Once the upper tool is closed against the lower tool 48 with the preformed blank B therebetween, the preformed blank B is finish-formed by heating the preformed blank B and applying the gas pressure. As is known in quick-plastic-forming (QPF) operations, electrical resistance heating means are embedded in the tooling to maintain the tooling at preferred operating temperatures. The preferred operating temperature for the lower finish-form tool 48 is less than the preforming temperature, and is preferably about 400° C. to about 460° C. The finish-forming pressure is preferably greater than the preforming pressure, and is preferably on the order of about 250 to 500 psi. The preformed blank B accordingly takes the shape of the forming surface of the lower finish-form tool 48. In any case, the finish-forming step 190 involves initially forming relatively sharp curves with small radii. Within about 80 to 300 seconds, the preformed blank B assumes the shape of the finish-form tool 48 and is thereafter termed a finish-form, finish-formed blank, or finished component at this point in the process.

Preferably, the lower preform and finish-form tools 34, 48 are mounted to a common press platen 54 within a single press (not shown).

Referring again to FIG. 1, in step 200 the now finish-formed blank B is transferred from the finish-form station 18 to the cooling station 20 by the transfer mechanism 12 to complete the transfer line process T. Simultaneously, another blank B is loaded to the finish-form station 18 from the preform station 16 and yet another blank B is loaded to the preform station 16 from the prebend station 14.

Referring to FIG. 2, the cooling station 20 includes a cooling fixture 56 that is adapted to support the finish-formed blank with minimal surface contact therebetween. Accordingly, a relatively large surface area of the finish-formed blank is exposed to cooling air so as to cool the blank in accord with step 210 of FIG. 1.

Referring to FIG. 1, in step 220 the now cooled finish-formed blank is unloaded from the cooling fixture by a material handling mechanism, such as a robot, pick-and-place unit, or the like.

Accordingly, the present invention provides several advantages. For example, the present invention provides higher productivity or throughput in the form of reduced cycle times when compared to prior superplastic forming techniques. Whereas, the cycle time of some double-action two-stage hot blow-forming processes is equal to the sum of the cycle times of each stage, the cycle time of the present invention process is equal to the largest cycle time of any given station in the process. In other words, the cycle time of the present invention is equal to the constraint of the transfer line, which is typically the finish-forming station 18. To illustrate, the cycle time of a typical process for a double-action two-stage tool would equal the sum of both the preform and finish-form steps, i.e. 20–100 seconds and 80–300 seconds for a total of between 100 to 400 seconds. In contrast, the cycle time for the same component using the process of the present invention would equal only 80–300 seconds, which is the constraint cycle time of the finish-form step, for a reduction in cycle time of at least about 20%. Another advantage is that the present invention uses relatively simpler forming tools that do not require die cushion assemblies or any other type of double-action devices or methods.

The present invention also contemplates use of the two or more forming stations having substantially equal cycle times so as to further minimize the overall process cycle time. In other words, the 20 to 100 second preform operation and the 80 to 300 second finish-forming operation described above can be averaged out among two or more single-action tool stages having substantially equal cycle times. For example, the previously described preform and finish-forming stages can be averaged out into a 50 to 200 second preform stage and a 50 to 200 second finish-forming stage. The present invention also contemplates use of more than two forming stations having relatively inexpensive single-action forming tools, wherein the three or more forming stations are capable of fully forming a three dimensional component from a blank in a shorter period of time than a double-action forming tool. In such a case, the previously described preform and finish-forming stages can be spread out among three 35 to 135 second forming stages, or four 25 to 100 second forming stages, and so on.

In balancing out the individual station cycle times, the process temperatures and pressures and the tool geometry are carefully predetermined for a given component design to achieve optimal stretch rates for producing a quality component. This is because excessive stretch or strain rates yield unacceptably high forming stresses on the sheet metal blank, and inadequate strain rates may also adversely affect the forming characteristics of the sheet metal. In one example, it may be desirable to maintain the last or finish station along the transfer line at a relatively cooler temperature for more distortion-free removal of the finished part therefrom. Accordingly, it is necessary to compensate for the lower temperature by using a higher forming pressure at this last station to achieve an optimal strain rate that does not yield defects in the formed part. Where, however, the process parameters cannot be adjusted any further to achieve a quality part, consideration may be given to distributing some of the finish forming work across two or more stations to maintain a low cycle time.

It should be understood that the invention is not limited to the embodiments that have been illustrated and described herein, but that various changes may be made without departing from the spirit and scope of the invention. For example, the present invention may be practiced in accordance with press-heated tooling such as a heated tunnel similar to known superplastic forming presses and apparatuses. In another example, the transfer mechanism or apparatus could be composed of three or more individual robots. Accordingly, it is intended that the invention not be limited to the disclosed embodiments, but that it have the full scope permitted by the language of the following claims.

What is claimed is:

1. A method of hot blow-forming a substantially three-dimensional component from a substantially two-dimensional blank using hot blow-forming tooling, said method comprising:

moving said blank to a first stage forming tool of a first stage forming station;

forming said blank into a first stage form by pressing one side of said blank so that an opposite side of said blank is brought into conformance with a forming surface of said first stage forming tool;

moving said first stage form from said first stage forming tool of said first stage forming station to a second stage forming tool of a second stage forming station; and forming said first stage form into a second stage form by applying a pressurized working gas against one side of said first stage form so that an opposite side of said first stage form is brought into conformance with a forming surface of said second stage forming tool that is internally heated to a second stage forming temperature, and by increasing the pressure of said working gas from ambient pressure to a second stage forming pressure;

said moving steps being carried out by a transfer apparatus that simultaneously transfers said blank and said first stage form.

2. A method as claimed in claim 1 wherein said blank is composed of an aluminum alloy.

3. A method as claimed in claim 2, wherein second stage forming temperature is on the order of between about 400° C. and about 460° C.

4. A method as claimed in claim 3 wherein said second stage forming pressure is on the order of between about 250 and about 500 psi.

5. A method as claimed in claim 4 wherein said transfer apparatus is a reciprocating transfer mechanism.

6. A method of quick-plastic-forming a substantially three-dimensional component from a substantially two-dimensional blank in multiple forming stages having electrically heated single-action tooling, said method comprising:

preheating said blank to a preheat temperature to create a preheated blank for stretch elongation thereof under the pressure of a working gas;

loading said preheated blank to a prebending station;

prebending said prebent preheated blank along at least one axis thereof to create a prebent preheated blank;

moving said prebent preheated blank to a preforming tool of a preforming station;

preforming said preheated blank into a preform by applying a pressurized working gas to one side of said prebent preheated blank so that an opposite side of said prebent preheated blank is brought into conformance with a forming surface of said preforming tool that is internally heated to a preforming temperature, and by increasing the pressure of said working gas from ambient pressure to a preforming pressure;

moving said preform from said preforming tool of said preforming station to a finish-forming tool of a finish-forming station;

finish-forming said preform into said component by applying a pressurized working gas against one side of said preform so that an opposite side of said preform is brought into conformance with a finish-form surface of said finish-form tool that is internally heated to a finish-forming temperature that is lower than said preforming temperature, and by increasing the pressure of said working gas from ambient pressure to a finish-forming pressure that is higher than said preforming pressure;

moving said component to a cooling station;

allowing said component to cool; and unloading said component from said cooling station;

said moving steps being carried out by a reciprocating transfer mechanism.

7. A method as claimed in claim 6 wherein said blank is composed of an aluminum alloy.

8. A method as claimed in claim 7, wherein said preforming temperature is on the order of between about 475° C. and about 550° C. and said finish-forming temperature is on the order of between about 400° C. and about 460° C.

9. A method as claimed in claim 8 wherein said first stage forming pressure is on the order of between about 100 and about 300 psi and said second stage forming pressure is on the order of between about 250 and about 500 psi.

10. A method of quick-plastic-forming a substantially three-dimensional component from a substantially two-dimensional aluminum alloy blank in multiple forming stages having electrically heated single-action tooling, said method comprising:

preheating said blank to between about 475° C. and about 550° C. to create a preheated blank for stretch elongation thereof under the pressure of a working gas;

loading said preheated blank to a prebending station;

prebending said preheated blank along at least one axis thereof to create a prebent preheated blank;

moving said prebent preheated blank to a preforming tool of a preforming station;

preforming said prebent preheated blank into a preform by applying a pressurized working gas to one side of said prebent preheated blank so that an opposite side of said prebent preheated blank is brought into conformance with a forming surface of said preforming tool that is internally heated to between about 475° C. and about 550° C., and by increasing the pressure of said working gas from ambient pressure to a preforming pressure;

moving said preform from said preforming tool of said preforming station to a finish-forming tool of a finish-forming station;

finish-forming said preform into said component by applying a pressurized working gas against one side of said preform so that an opposite side of said preform is brought into conformance with a finish-form surface of said finish-form tool that is internally heated to between about 400° C. and about 460° C., and by increasing the pressure of said working gas from ambient pressure to a finish-forming pressure that is higher than said preforming pressure;

moving said component to a cooling station;

allowing said component to cool; and unloading said component from said cooling station;

said moving steps being carried out by a reciprocating transfer mechanism.

11. A method as claimed in claim 10 wherein said preforming pressure is on the order of between about 100 and about 300 psi and said finish-forming pressure is on the order of between about 250 and about 500 psi.

* * * * *